US008593381B2

(12) United States Patent
Osame et al.

(10) Patent No.: US 8,593,381 B2
(45) **Date of Patent: *Nov. 26, 2013**

(54) METHOD OF DRIVING LIGHT-EMITTING DEVICE

(75) Inventors: Mitsuaki Osame, Kanagawa (JP); Aya Anzai, Kanagawa (JP); Yu Yamazaki, Tokyo (JP); Tomoyuki Iwabuchi, Kanagawa (JP)

(73) Assignee: Semiconductor Energy Laboratory Co., Ltd. (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/609,712

(22) Filed: Sep. 11, 2012

(65) Prior Publication Data

US 2013/0002622 A1 Jan. 3, 2013

Related U.S. Application Data

(63) Continuation of application No. 11/656,909, filed on Jan. 22, 2007, now Pat. No. 8,274,458, which is a continuation of application No. 10/394,955, filed on Mar. 21, 2003, now Pat. No. 7,170,478.

(30) Foreign Application Priority Data

Mar. 26, 2002 (JP) ..... 2002-087070

(51) Int. Cl.
*G09G 3/32* (2006.01)

(52) U.S. Cl.
USPC ..... 345/82; 345/83

(58) Field of Classification Search
USPC ..... 345/76–100, 204, 205, 211, 214; 313/504, 505; 315/169.1, 169.3; 349/41, 49
See application file for complete search history.

(56) References Cited

U.S. PATENT DOCUMENTS 4,962,374 A 10/1990 Fujioka et al.
5,483,256 A 1/1996 Ohi (Continued)

FOREIGN PATENT DOCUMENTS

EP 1 061 497 A1 12/2000
EP 1 094 436 A2 4/2001

(Continued)

OTHER PUBLICATIONS

Tang, C.W. et al, "Organic Electroluminescent Diodes," Applied Physics Letters, vol. 51, No. 12, Sep. 21, 1987, pp. 913-915.

(Continued)

*Primary Examiner* — Prabodh M Dharia
(74) *Attorney, Agent, or Firm* — Husch Blackwell LLP

(57) ABSTRACT

Degradations in light emitting elements occur with the passage of time. The invention provides a method of driving a light-emitting device provided with a plurality of pixels, which includes a light-emitting means with a first and a second electrodes, a drive means for supplying the light-emitting means with a current in response to an analog video signal, and a setting means for setting a sustaining period and an off time period within a frame period. The method of driving a light-emitting device is characterized by including the steps of: supplying the light-emitting means with the current in response to the analog video signal during the sustaining period; and turning the drive means off thereby to make the light-emitting means nonluminous or making the first and the second electrodes identical in potential thereby to make the light-emitting means nonluminous during the off time period.

18 Claims, 7 Drawing Sheets

(56) References Cited

U.S. PATENT DOCUMENTS

| | | | | |
|---|---|---|---|---|
| 5,552,678 | A | 9/1996 | Tang et al. | |
| 5,751,263 | A | 5/1998 | Huang et al. | |
| 6,011,529 | A | 1/2000 | Ikeda | |
| 6,140,993 | A | 10/2000 | Pathak et al. | |
| 6,243,082 | B1 | 6/2001 | Konishi | |
| 6,246,180 | B1 | 6/2001 | Nishigaki | |
| 6,249,269 | B1 | 6/2001 | Bialock et al. | |
| 6,486,606 | B1 | 11/2002 | Ting | |
| 6,498,596 | B1 | 12/2002 | Nakamura et al. | |
| 6,501,230 | B1 | 12/2002 | Feldman | |
| 6,583,775 | B1 | 6/2003 | Sekiya et al. | |
| 6,661,180 | B2 | 12/2003 | Koyama | |
| 6,686,898 | B2 | 2/2004 | Chen et al. | |
| 6,710,757 | B2 | 3/2004 | Wu | |
| 6,738,034 | B2 | 5/2004 | Kaneko et al. | |
| 6,795,064 | B2 | 9/2004 | Walker et al. | |
| 6,809,481 | B2 | 10/2004 | Seo et al. | |
| 6,819,317 | B1 | 11/2004 | Komura et al. | |
| 6,825,496 | B2 | 11/2004 | Yamazaki et al. | |
| 6,903,731 | B2 * | 6/2005 | Inukai | 345/204 |
| 6,914,390 | B2 | 7/2005 | Koyama | |
| 6,950,081 | B2 * | 9/2005 | Akimoto et al. | 345/55 |
| 7,123,220 | B2 | 10/2006 | Hanari et al. | |
| 7,123,237 | B2 | 10/2006 | Sato et al. | |
| 7,170,478 | B2 | 1/2007 | Osame et al. | |
| 7,184,034 | B2 | 2/2007 | Kimura | |
| 7,230,591 | B2 | 6/2007 | Inukai et al. | |
| 7,259,521 | B1 | 8/2007 | Ritter | |
| 7,468,715 | B2 * | 12/2008 | Akimoto et al. | 345/82 |
| 7,483,002 | B2 | 1/2009 | Kaneko et al. | |
| 2002/0021266 | A1 | 2/2002 | Koyama et al. | |
| 2002/0044140 | A1 * | 4/2002 | Inukai | 345/204 |
| 2002/0084810 | A1 | 7/2002 | Le | |
| 2002/0130828 | A1 | 9/2002 | Yamazaki et al. | |
| 2003/0057895 | A1 * | 3/2003 | Kimura | 315/370 |
| 2003/0062545 | A1 * | 4/2003 | Yamazaki et al. | 257/200 |
| 2003/0063078 | A1 | 4/2003 | Hanari et al. | |
| 2003/0067424 | A1 * | 4/2003 | Akimoto et al. | 345/55 |
| 2003/0184238 | A1 | 10/2003 | Osame et al. | |
| 2004/0217778 | A1 | 11/2004 | Miyake | |
| 2005/0104528 | A1 | 5/2005 | Seo et al. | |
| 2006/0214891 | A1 | 9/2006 | Hanari et al. | |
| 2009/0153449 | A1 | 6/2009 | Kaneko et al. | |

FOREIGN PATENT DOCUMENTS

| | | |
|---|---|---|
| JP | 6-301355 | 10/1994 |
| JP | 10-214060 | 8/1998 |
| JP | 10-312173 | 11/1998 |
| JP | 2000-347621 | 12/2000 |
| JP | 2000-347622 | 12/2000 |
| JP | 2001-42822 | 2/2001 |
| JP | 2001-60076 | 3/2001 |
| JP | 2002-91376 | 3/2002 |
| JP | 2002-236470 | 8/2002 |
| WO | WO 98/33165 A1 | 7/1998 |
| WO | WO 98/48403 A1 | 10/1998 |

OTHER PUBLICATIONS

Van Slyke, S.A. et al, "Organic Electroluminescent Devices with Improved Stability," Applied Physics Letters, vol. 69, No. 15, Oct. 7, 1996, pp. 2160-2162.

Sato, Y., "Problem for Implementation in View of Materials Development," The Japan Society of Applied Physics, Organic Molecular Electronics and Bioelectronics, vol. 11, No. 1, 2000, pp. 86-99; (with partial English translation: p. 95, line 1 through p. 96, line 7).

* cited by examiner

METHOD OF DRIVING LIGHT-EMITTING DEVICE

This application is a continuation of U.S. application Ser. No. 11/656,909, filed on Jan. 22, 2007 (now U.S. Pat. No. 8,274,458 issued Sep. 25, 2012) which is a continuation of U.S. application Ser. No. 10/394,955, filed on Mar. 21, 2003 (now U.S. Pat. No. 7,170,478 issued Jan. 30, 2007).

BACKGROUND OF THE INVENTION

1. Field of the Invention

The present invention relates to a technique for a light emitting device, more specifically, the invention relates to a driving method of the light emitting device.

2. Description of the Related Art

Recently, display devices for performing image display have been developed. Liquid crystal display devices that perform image display by using liquid crystal elements are widely used as display devices for mobile phones and personal computers because of advantages of high image quality, thinness, lightweight, and the like.

On the other hand, light emitting devices using the light emitting elements also have been developed in last years. Since the light emitting device needs no backlight, in addition to advantages of low power consumption, compact, lightweight, the light emitting device has characteristics of, for example, a high response speed suitable for moving image display, wide view, and thus, attracts a great deal of attention as flat panel display using for next generation small-size mobiles, which is available for full color moving image contents.

The light emitting element is constituted by a wide variety of materials, such as an organic material, an inorganic material, a thin film material, a bulk material, a dispersion material and so on. An organic light emitting diode (OLED) essentially constituted by an organic material can be an example of a typical light emitting element. The light emitting element has a structure of an anode, a cathode, and a light emitting layer sandwiched between the anode and cathode. The light emitting layer is constituted by one or more materials selected from the above materials.

A current flowing to the light emitting element is in directly proportional to the brightness of the light emitting element, the light emitting element emits light corresponding to an amount of the current flowing to the light emitting layer.

Incidentally, as driving methods used in displaying a multi-gradation image on a light emitting device, an analog gradation method and a digital gradation method are given. The former analog gradation method is a method in which a current is flown to the light emitting element corresponding to a desired gradation and the gradation is represented based on the magnitude of the current. The latter digital gradation method is a method in which the light emitting element is driven only in two states thereof: an ON state (state where the brightness is substantially 100%) and an OFF state (state where the brightness is substantially 0%).

Further, as driving methods for displaying multi-gradation images on the light emitting device, a voltage input method and a current input method are given. The former voltage input method is a method in which: a video signal (voltage) that is input to a pixel is input to a gate electrode of a driving element; and the driving element is used to control the brightness of a light emitting element. The latter current input method is a method in which the set signal current is flown to a light emitting element to control the brightness of the light emitting element. Both the analog gradation method and digital gradation method can be applied to the voltage input method and the current input method.

In order to provide a display device and a driving method thereto, which are capable of improving operation reliability of the light emitting element, a method of reducing light emission time of the pixel is given. (Refer to patent document 1)

[Patent Document 1] Patent Publication No. 2000-347622

The operations of a light-emitting device, to which the above-described analog gradation method is applied, will be described in reference to the timing chart of FIG. 7. In the timing chart of FIG. 7, the horizontal axis shows time and the vertical axis shows rows of the scanning line.

In the analog gradation method, as shown in FIG. 7, one frame period (F) is divided into: an addressing period ($T_a$) during which a video signal is written into a pixel; and a sustaining period ($T_s$) during which the pixel emits light in response to the video signal. The addressing period ($T_a$) and sustaining period ($T_s$) arise alternately, as time passes. In this case, the period during which each pixel emits light occupies much of one frame period. Therefore, each pixel emits light almost continuously unless the "black" video signal is input.

SUMMARY OF THE INVENTION

This causes a light-emitting element of each pixel to be degraded with the passage of time. The degradation of light-emitting elements leads to variations between pixels in brightness at which the light-emitting elements emit light even with the same amount of current flowing through the pixels, and results in a display pattern burn-in. As a result, it becomes difficult to display images represented with exact gradations in a light-emitting device.

Therefore, the present invention was made in consideration of the foregoing problems. It provides a method of driving a light-emitting device wherein each frame period contains a period during which a pixel is nonluminous (off time period).

Setting such off time period in each frame period can produce a period during which a light-emitting element included by each pixel is nonluminous. Consequently, a degradation with age of light-emitting elements can be reduced. In addition, reliability of light-emitting element can be improved.

The invention provides a method of driving a light-emitting device provided with a plurality of pixels, which includes a light-emitting means with a first and a second electrodes, a drive means for supplying the light-emitting means with a current in response to an analog video signal, and a setting means for setting a sustaining period and an off time period within a frame period. The method of driving a light-emitting device is characterized by including the steps of: supplying the light-emitting means with the current in response to the analog video signal during the sustaining period; and turning the drive means off thereby to make the light-emitting means nonluminous or making the first and the second electrodes identical in potential thereby to make the light-emitting means nonluminous during the off time period.

The light-emitting means corresponds to a light-emitting element, and more specifically to a light-emitting element made of any of a wide variety of materials such as an organic material, an inorganic material, a thin film material, a bulk material, and a dispersion material. The light-emitting element has a structure such that the light-emitting element has an anode and a cathode, and a light-emitting layer held between the anode and the cathode. The light-emitting layer is formed from one or more materials selected from the above-described materials.

The above-described drive means corresponds to a element connected to the light-emitting means, and more specifically to a transistor connected to the light-emitting means. In each of the pixels, which the voltage-input method is applied to, a current between the source and the drain of the transistor is determined by inputting analog video signals to the gate electrode of the transistor and then the current between the source and the drain is supplied to the light-emitting element. On the other hand, in each of the pixels, which the current-input method is applied to, a given signal current is supplied across the source and the drain of the transistor and then the current between the source and the drain is supplied to the light-emitting element.

The setting means includes elements placed in the pixel, and more specifically a switching transistor, i.e. an element having a function of controlling the input of signals into the pixel. The setting means also includes a scanning line drive circuit, and the like, a signal line drive circuit, a control circuit, and the like, which are placed in surrounding areas of the pixel.

The invention provides a method of driving a light-emitting device, which has a light-emitting means with a first and a second electrodes, a drive means for supplying the light-emitting means with a current in response to an analog video signal, a first setting means for setting n sustaining periods (n is a natural number greater than or equal to one (1)) within a frame period, and a second setting means for setting an off time period. The method of driving a light-emitting device is characterized by including steps of supplying the light-emitting means with the current in response to the analog video signal during the n sustaining periods; and making the first or second electrode electrically floated thereby to make the light-emitting means nonluminous or making the first and the second electrodes identical in potential thereby to make the light-emitting means nonluminous during the off time period.

The first setting means includes elements placed in the pixel, and more specifically an element each having a function of controlling the input of signals into the pixel. The first setting means also includes a scanning line drive circuit, a signal line drive circuit, a control circuit, and the like, which are placed in surrounding areas of the pixel.

The above-described second setting means includes a line for supplying the light-emitting means with current, a power source connected to the line, a switch placed between the line and the power source, a control circuit for controlling the switch, and the like.

Further, a feature of the invention is that each of the pixels of the light-emitting device, to which the invention is applied, is provided with a capacitive means.

The capacitive means corresponds to any of a capacity element provided in the pixel, a gate capacitance and a channel capacitance of the drive means, or a parasitic capacitance of the lines, etc. When the gate capacitance and channel capacitance of the drive means are used as the capacitive means, it is not required to place a capacity element in the pixel additionally. Incidentally, the capacitive means serves to hold analog video signals. In other words, the capacitive means serves to hold the voltage between the gate and the source of the drive means.

DESCRIPTION OF THE PREFERRED EMBODIMENTS

First Embodiment

In this embodiment, an exemplary arrangement of a light-emitting device, to which the present invention can be applied, will be described in reference to FIGS. 4A-4D. Subsequently, a method of driving a light-emitting device according to the invention will be described in reference to FIGS. 1A, 1B, 2A and 2B.

Figure 4A:
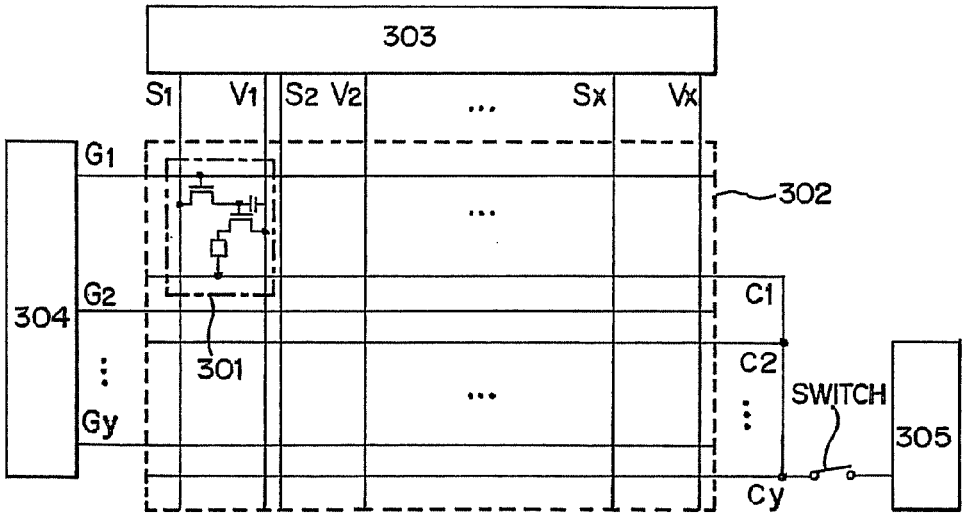
FIGS. 4A-4D are illustrations used for the explanation of a light-emitting device, to which the invention may be applied.

Referring now to FIG. 4A, which shows a light-emitting device in outline. The light-emitting device has a pixel portion 302, a signal line drive circuit 303 and a scanning line drive circuit 304, both of which are located on the periphery of the pixel portion 302, and a power source 305.

The pixel portion 302 has x signal lines $S_1$ to $S_x$ and x source lines $V_1$ to $V_x$, which are arranged to extend in the direction of columns, and y scanning lines $G_1$ to $G_y$ and y source lines $C_1$ to $C_y$, which are arranged to extend in the direction of rows (x and y are natural numbers). An area surrounded by a pair of a signal line $S_1$ to $S_x$ and a source line $V_1$ to $V_x$ and a pair of a scanning line $G_1$ to $G_y$ and a source line $C_1$ to $C_y$ corresponds to one pixel 301. The pixel portion 302 has a plurality of pixels 301 arranged in the form of a matrix.

The signal line drive circuit 303, scanning line drive circuit 304, etc. may be formed in one piece with the pixel portion 302 on a substrate, otherwise they may be located outside the substrate where the pixel portion 302 is formed. Furthermore, the numbers of the signal line drive circuit 303 and scanning line drive circuit 304 are not limited specifically. In other words, the numbers of the signal line drive circuit 303 and scanning line drive circuit 304 may be determined arbitrarily depending on the arrangement of the pixels 301. In addition, the signal line drive circuit 303, scanning line drive circuit 304, etc. are supplied with signals from the outside through FPC or the like (now shown).

Figure 4B:
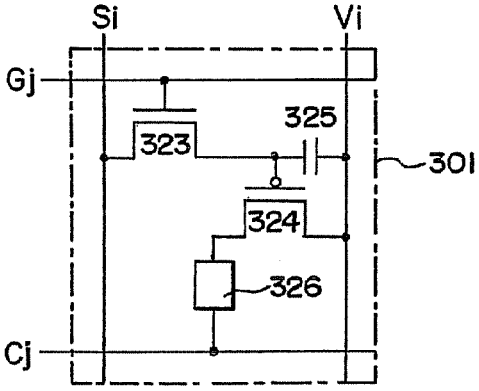

Now, the arrangement of a pixel 301 arranged in the i-th column and the j-th row of the pixel portion 302 will be described in detail in reference to FIG. 4B. The pixel 301 has a switching transistor 323, a driving transistor 324, a capacity element 325, and a light-emitting element 326.

The switching transistor 323 has a gate electrode connected to the scanning line a first electrode connected to the signal line $S_1$, and a second electrode connected to the gate electrode of the driving transistor 324. The first electrode of the driving transistor 324 is connected to the source line $V_i$ and the second electrode thereof is connected to one electrode of the light-emitting element 326. The other electrode of the light-emitting element 326 is connected to the source line $C_j$.

The capacity element 325 is connected between the gate electrode and the first electrode of the driving transistor 324, and holds a voltage between the gate and the source of the driving transistor 324.

Herein, one electrode of the light-emitting element 326 connected to the second electrode of the driving transistor 324 is referred to as a pixel electrode and the other electrode connected to the source line $C_j$ is referred to as an opposite electrode.

The switching transistor 323 has a function of controlling the input of signals into the pixel 301. The switching transistor 323 may be a transistor with a function as a switch and therefore the conductivity type thereof is not restricted specifically. In other words, either of n-channel type or p-channel type transistor may be used as the switching transistor 323.

The driving transistor 324 has a function of controlling the light-emitting element 326 in light emission. The conductivity type of the driving transistor 324 is not restricted specifically. However, when the driving transistor 324 is of p-channel type, the pixel electrode and the opposite electrode serve as an anode and a cathode, respectively. Further, when the driving transistor 324 is of n-channel type, the pixel electrode and the opposite electrode are used as a cathode and an anode, respectively.

The switching transistor 323 and driving transistor 324 may be of not only single gate structure with only one gate electrode but also multigate structure, such as double gate structure with two gate electrodes, triple gate structure with three gate electrodes, or the like. Also, the switching transistor 323 and driving transistor 324 may have either of top gate structure where a gate electrode is located on the top of the semiconductor or bottom gate structure where a gate electrode is located on the bottom of the semiconductor.

While a capacity element 325 is also located in the pixel 301, the invention is not limited to such arrangement. In other words, the gate capacitance or channel capacitance of the driving transistor 324 may be used instead of the capacity element 325, otherwise the parasitic capacitance produced by the wiring, etc. may be used instead thereof. The capacity element 325 serves to hold an analog video signal.

Figure 1A:
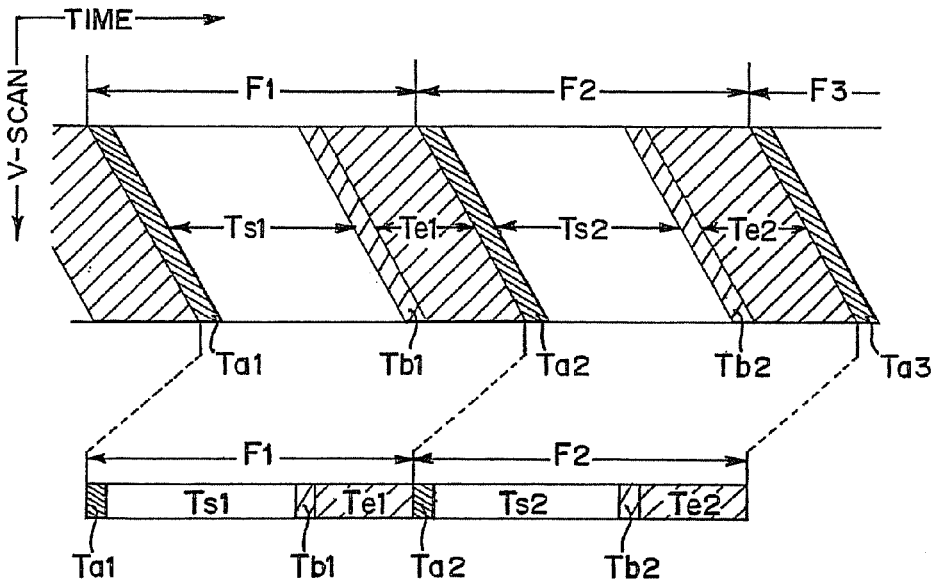
FIGS. 1A and 1B are illustrations used for the explanation of a method of driving a light-emitting device according to the invention.
Figure 1B:
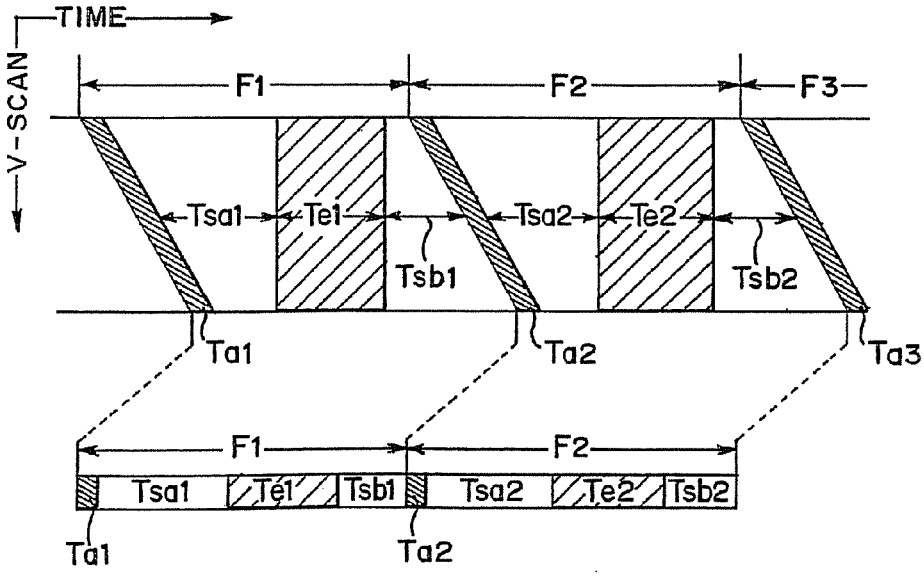

The timing charts of FIGS. 1A and 1B were obtained in the cases where different driving methods were applied, respectively. In this embodiment, a method of driving a light-emitting device according to the invention is described in reference to FIGS. 1A and 1B.

A light-emitting device of the invention may be either of the above-described voltage-input type or the current-input type. However, in the embodiment, the case where the voltage-input type is applied to the light-emitting device will be described below.

In the timing chart shown in upper part of FIG. 1A, the horizontal axis indicates time and the vertical axis indicates scanning lines. Further, upper part of FIG. 1A shows timing charts of the first addressing period $T_a$, the sustaining period $T_s$ the second addressing period $T_b$, and the off time period $T_e$. Lower part of FIG. 1A shows a timing chart on a certain scanning line.

First, during the first addressing period $T_{a1}$ of the first frame $F_1$, a signal is input to the scanning line $G_1$ from the scanning line drive circuit 304, whereby the scanning line $G_1$ is selected. Then, the switching transistors 323 of all pixels 301 connected to the scanning line $G_1$ (pixels 301 in the first row) are turned on.

The pixels in the first row are subjected to the point sequential scanning through the signal lines $S_1$ to $S_x$ from the signal line drive circuit 303. Then, analog video signals are input in turn to the first to x-th (last) column pixels 301 located in the first row to cause the pixels 301 to emit light in response to the analog video signals. More specifically, the analog video signal is input to the gate electrode of the driving transistor 324 through the switching transistor 323 of each of the pixels 301. A voltage between the gate and the source of the driving transistor 324 depends on the potential of the input analog video signal, whereby a current flowing between the source and the drain of the driving transistor 324 is determined. When the current is supplied to the light-emitting element 326, the light-emitting element 326 emits light.

Now, to input an analog video signal to the gate electrode of the driving transistor 324 is herein expressed as to input a video signal to the pixel 301.

As soon as the analog video signals are input to all the pixels 301 in the first row in this way, the light-emitting elements 326 emit light. Then, the sustaining period $T_{s1}$ starts for the pixels 301 in the first row.

After the period during which the scanning line $G_1$ is selected expires, the scanning line $G_2$ is selected to repeat the above-described operation. After all the scanning lines $G_1$ to $G_y$ have been selected in turn in this way to complete the input of analog video signals to all the pixels 301, the first addressing period $T_{a1}$ expires. In each of the pixels 301, the sustaining period $T_{s1}$ starts as soon as the first addressing period $T_{s1}$ expires.

Subsequently, after the sustaining period $T_{s1}$ expires, the second addressing period $T_{b1}$ starts. During the second addressing period $T_{b1}$, a signal is input to the scanning line $G_1$ from the scanning line drive circuit 304, whereby the scanning line $G_1$ is selected. Then, the switching transistors 323 of pixels 301 connected to the scanning line $G_1$ (pixels 301 in the first row) are turned on.

Then, the pixels in the first row are subjected to the point sequential scanning through the signal lines $S_1$ to $S_x$ from the signal line drive circuit 303. During this time, signals, which cause the driving transistors 324 to turn off in turn to the first to x-th (last) column pixels 301 located in the first row, are input to the gate electrodes of the driving transistors 324 thereof. In more detail, because the driving transistor 324 is the p-channel type in the embodiment, the High-level signal is input to the gate electrode of the driving transistor 324. Incidentally, if the driving transistor 324 is of the n-channel type, the Low-level signal is input. When the High-level signal is input to the driving transistor 324, the transistor is turned off, whereby no current can flow through the light-emitting element 326. Then, the light-emitting element 326 becomes nonluminous.

As soon as the High-level signals are input to the pixels 301 in the first row in this way, the light-emitting elements 326 thereof become nonluminous, and therefore the off time period $T_{e1}$ starts for the pixels 301 in the first row.

After the period during which the scanning line $G_1$ is selected expires, the scanning line $G_2$ is selected to repeat the above-described operation. After all the scanning lines $G_1$ to $G_y$ have been selected in turn in this way to complete the input of the High-level signals to all the pixels, the second addressing period $T_{b1}$ expires. In each of the pixels 301, the off time period $T_{e1}$ starts as soon as the second addressing period $T_{b1}$ expires.

Subsequently, after the off time period $T_{e1}$ expires, the first frame $F_1$ expires. As soon as the first frame $F_1$ expires, the second frame $F_2$ starts. The frames are repeated sequentially in this way.

Figure 2A:
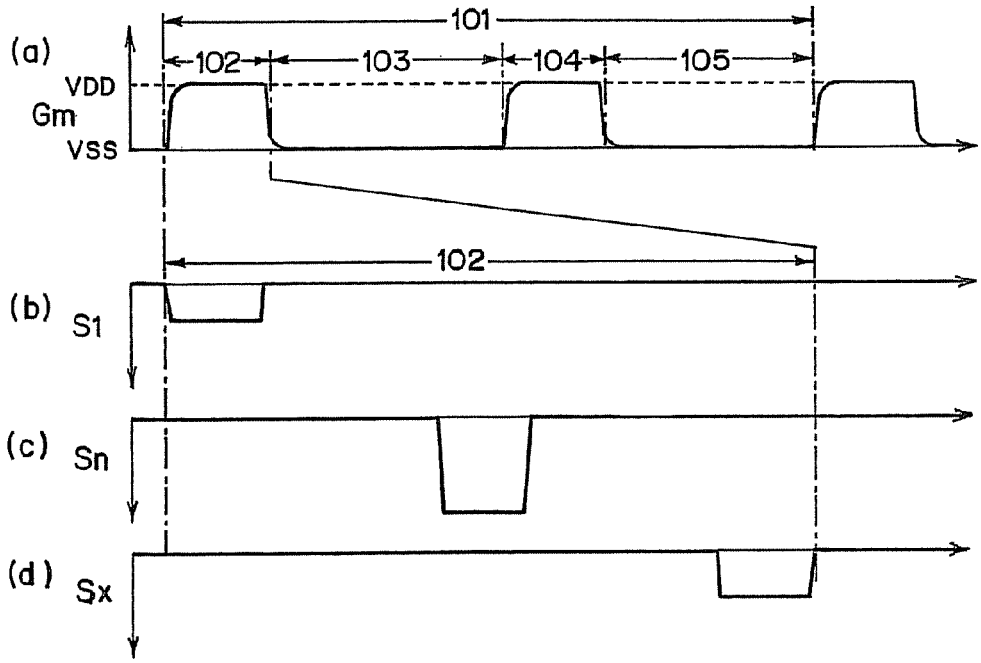
FIGS. 2A and 2B are illustrations used for the explanation of a method of driving a light-emitting device according to the invention.
Figure 2B:
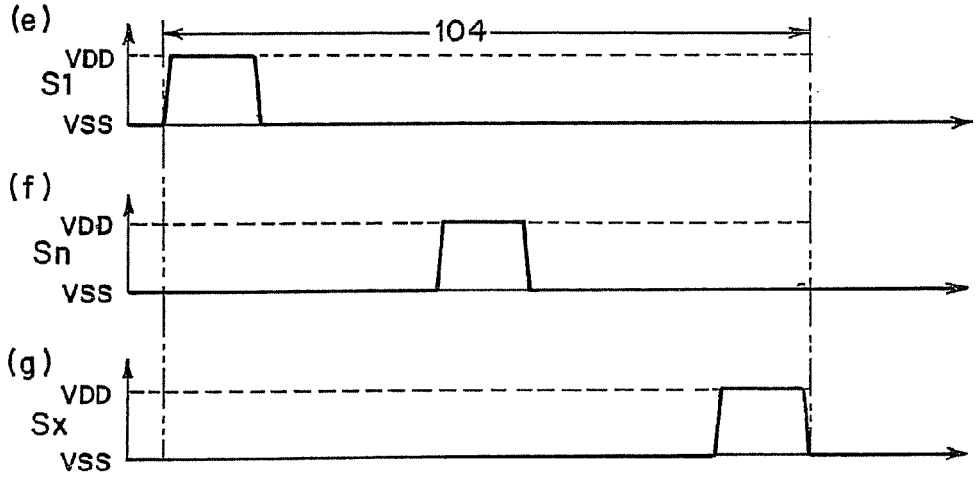

Referring now to FIGS. 2A and 2B showing voltages on the scanning line $G_m$ and signal lines $S_1$, $S_n$, and $S_x$ for each of the first addressing period $T_a$, the sustaining period $T_s$, the second addressing period $T_b$, and the off time period $T_e$, the operations during the periods will be described in more detail.

In FIGS. 2A and 2B, the horizontal axis shows time, and each vertical axis shows voltage, respectively. In FIGS. 2A and 2B, (a) shows the relation between the voltage on the m-th row scanning line $G_m$ and time (m is a natural number; $1 \leq m \leq y$). (b) and (e) show the relation between the voltage on the first column signal line $S_1$ and time. (c) and (f) show the relation between the voltage on the n-th column signal line $S_n$ and time (n is a natural number; $n \leq x$). (d) and (g) show the relation between the voltage on the x-th (last) column signal line $S_x$ and time.

In FIG. 2A, the period indicated by 101 corresponds to one frame. The periods indicated by 102 and 104 belong to the first and the second addressing periods $T_a$ and $T_b$, respectively. Each of these addressing periods corresponds to one horizontal scanning period. Further, the period indicated by 103 corresponds to the sustaining period $T_s$. The period indicated by 105 corresponds to the off time period $T_e$.

Now, the voltages on the first to x-th column signal lines $S_1$ to $S_x$ during the period 102 will be described in reference to FIG. 2A.

In the period 102, a signal is input to the m-th row scanning line $G_m$ from the scanning line drive circuit 304, whereby the scanning line $G_m$ is selected. Then, the switching transistors 323 of all pixels 301 connected to the scanning line $G_m$ (pixels 301 in the m-th row) are turned on.

In this state, as shown in (b) to (d), the pixels in the m-th row are subjected to the point sequential scanning and thus analog video signals are input in turn to the first to x-th column pixels 301 located in the m-th row through the signal lines $S_1$ to $S_x$ from the signal line drive circuit 303.

Next, the voltages on the first to x-th column signal lines $S_1$ to $S_x$ during the period 104 will be described in reference to FIG. 2B.

In the period 104, a signal is input to the m-th row scanning line $G_m$ from the scanning line drive circuit 304, whereby the scanning line $G_m$ is selected. Then, the switching transistors 323 of all pixels 301 connected to the scanning line $G_m$ (pixels 301 in the m-th row) are turned on.

In this condition, as shown in FIGS. 2A and 2B, the High-level signals are input in turn to the first to x-th column pixels 301 located in the m-th row through the signal lines $S_1$ to $S_x$ by the signal line drive circuit 303.

Incidentally, the illustrations of periods concerning the horizontal retrace line are omitted in FIGS. 2A and 2B.

As described above, a feature of the method of driving a light-emitting device in the embodiment is that two addressing periods, the first and the second addressing periods $T_a$ and $T_b$, are set generally in one frame. During the first addressing period $T_a$, analog video signals are written into the pixels 301; during the second addressing period $T_b$, signals to turn off the driving transistors 324 are written into the pixels 301. Further, as soon as the second addressing period $T_b$ expires, the off time period $T_e$ during which the pixel 301 is nonluminous starts. A feature of the method of driving a light-emitting device in the embodiment is also that the off time period $T_e$ is set in one frame in this way. Setting the off time period $T_e$ can produce a period during which the light-emitting element included in each pixel is nonluminous. As a result, the degradation with age of light-emitting elements can be reduced. In addition, the reliability of light-emitting elements can be increased.

A feature of the method of driving a light-emitting device in the embodiment is that the start timings of the off time period $T_e$ vary among the pixels 301. In other words, the off time period $T_e$ starts differently for each of the pixels 301.

While one off time period $T_e$ is set for each frame in this embodiment, the invention is not so limited. One off time period $T_e$ may be set every a few frames. Further, a few off time periods $T_e$ may be set for each frame. However, it is required to set the first and the second addressing periods $T_a$ and $T_b$ such that they do not overlap with each other. The reason for this is: if the first and the second addressing periods $T_a$ and $T_b$ are executed simultaneously, two scanning lines are selected at the same timing and therefore signals can not be input to the pixels 301 from the signal line drive circuit 303 correctly.

Second Embodiment

In this embodiment, a method of driving a light-emitting device different from the first embodiment will be described in reference to FIGS. 1B and 3A to 3E.

Incidentally, either of the voltage-input type or the current-input type method, which have been described above, may be applied to a light-emitting device of the invention. However, in this embodiment, the case where the voltage-input type method is applied will be described below.

In the timing chart shown in FIG. 1B, the horizontal axis indicates time, and the vertical axis indicates the scanning lines. Further, upper part of FIG. 1B shows timing charts of the addressing period $T_a$, the first sustaining period $T_{sa}$, the second sustaining period $T_{sb}$, and the off time period $T_e$. Lower part of FIG. 1B shows a timing chart on a certain scanning line.

First, during the addressing period $T_{a1}$ of the first frame $F_1$, a signal is input to the scanning line $G_1$ from the scanning line drive circuit 304, whereby the scanning line $G_1$ is selected. Then, the switching transistors 323 of all pixels 301 connected to the scanning line $G_1$ (pixels 301 in the first row) are turned on.

The pixels in the first row are subjected to the point sequential scanning through the signal lines $S_1$ to $S_x$ from the signal line drive circuit 303. Then, analog video signals are input in turn to the first to x-th (last) column pixels 301 to cause the pixels 301 to emit light in response to the analog video signals. More specifically, the analog video signal is input to the gate electrode of the driving transistor 324 through the switching transistor 323 of the pixel 301. A voltage between the gate and the source of the driving transistor 324 depends on the potential of the input analog video signal, whereby a current flowing between the source and the drain of the driving transistor 324 is determined. When the current is supplied to the light-emitting element 326, the light-emitting element 326 emits light.

As soon as analog video signals are input to the pixels 301 in the first row in this way, the light-emitting element 326 emits light. Then, the first sustaining period $T_{sa1}$ starts for all the pixels 301 in the first row.

After the period during which the scanning line $G_1$ is selected expires, the scanning line $G_2$ is selected to repeat the above-described operation. After all the scanning lines $G_1$ to $G_y$ have been selected in turn in this way to complete the input of analog video signals to all the pixels 301, the addressing period $T_{a1}$ expires. In the pixels 301, the first sustaining period $T_{sa1}$ starts as soon as the addressing period $T_{a1}$ expires.

Subsequently, after the first sustaining period $T_{sa1}$ expires, the off time period $T_{e1}$ starts for all the pixels 301 simultaneously. In the off time period $T_{e1}$, a switch located between the source lines $C_1$ to $C_y$ and the power source 305 (See FIG. 4A) is turned off, whereby the power source 305 is prevented from supplying the light-emitting elements 326 with electric power. As a result, the opposite electrodes of the light-emitting elements 326 become electrically floated and thus no current flows through the light-emitting elements 326 to bring the elements to nonluminous states.

Further, the off time period $T_{e1}$ may be such that no current can be supplied to the light-emitting elements 326 by making the pixel electrodes of the light-emitting elements 326 and the respective opposite electrodes thereof identical in potential in the condition where the switch located between the source lines $C_1$ to $C_y$ and the power source 305 is held on. When there is no difference in potential between both electrodes of the light-emitting element 326, the light-emitting element 326 is supplied with no current and thus the light-emitting element 326 becomes nonluminous.

Subsequently, the switch located between the source lines $C_1$ to $C_y$ and the power source 305 is turned on after the off time period $T_{e1}$ has expired, whereby the second sustaining period $T_{sb1}$ starts. When the source lines $C_1$ to $C_y$ and the power source 305 are connected electrically, the light-emitting elements 326 can be supplied with electric power to pass electric current through the light-emitting elements 326.

The analog video signals written into the pixels during the addressing period $T_{a1}$ are continuously held by the capacity elements 325 during the off time period $T_{e1}$. Therefore, as soon as the second sustaining period $T_{sb1}$ starts to electrically connect between the source lines $C_1$ to $C_y$ and the power source 305, the display is performed with the same gradation as that in the first sustaining period $T_{sa1}$.

As described above, according to the invention, the analog video signals written into the pixels 301 are held by the capacity elements 325 during the off time period $T_{e1}$. Therefore, after the off time period $T_{e1}$ expires, it is not necessary to write signals into the pixels again and to place any storage media including a memory or the like.

When the second sustaining period $T_{sb1}$ expires, the first frame $F_1$ also expires. As soon as the first frame $F_1$ expires, the second frame $F_2$ starts. In this way, the frames are repeated in turn.

Figure 3A:
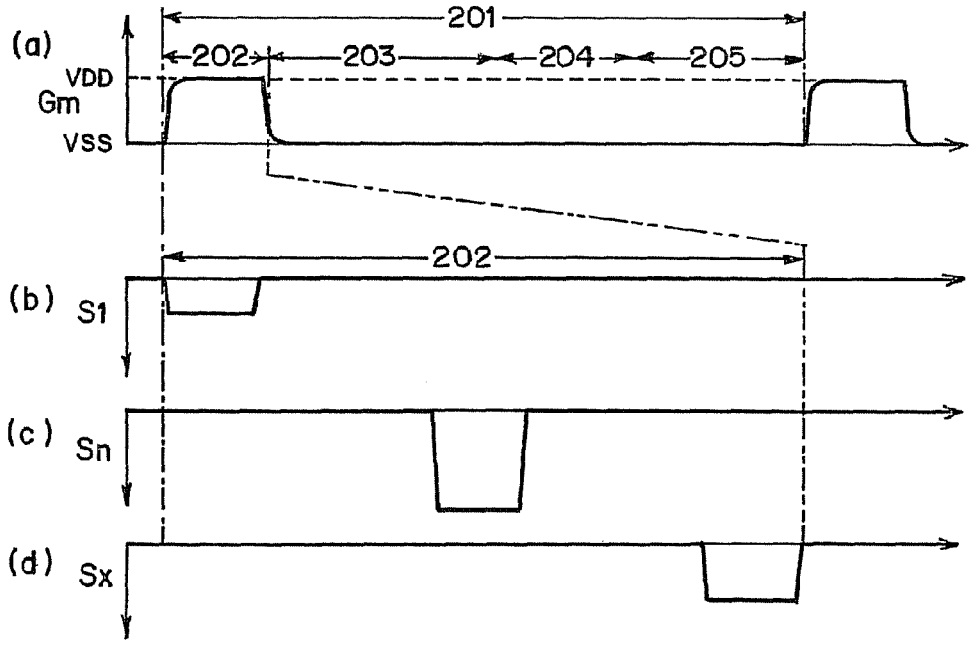
FIGS. 3A and 3B are illustrations used for the explanation of a method of driving a light-emitting device according to the invention.
Figure 3B:
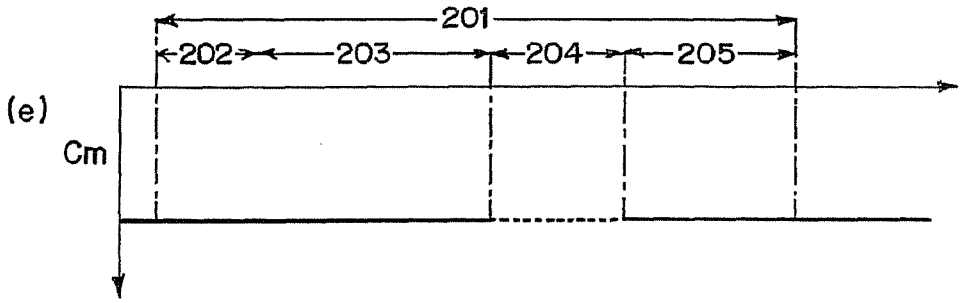

Referring now to FIGS. 3A and 3B, which show the voltages on the scanning line $G_m$, the signal lines $S_1$, $S_n$, and $S_x$, and the source line $C_m$ during the addressing period $T_a$, the first sustaining period $T_{sa}$, the second sustaining period $T_{sb}$, and the off time period $T_e$, the operations during the periods will be described in more detail.

In FIGS. 3A and 3B, the horizontal axis shows time, and each vertical axis shows voltage, respectively. (a) shows the relation between the voltage on the m-th row scanning line $G_m$ and time. (b) shows the relation between the voltage on the first column signal line $S_1$ and time. (c) shows the relation between the voltage on the n-th column signal line $S_n$ and time. (d) shows the relation between the voltage on the x-th (last) column signal line $S_x$ and time. FIG. 3B shows the relation between the voltage on the m-th row source line $C_m$ and time.

In (a) of FIG. 3A, the period indicated by 201 corresponds to one frame. The period indicated by 202 belongs to the addressing periods $T_a$, which corresponds to one horizontal scanning period. Further, the period indicated by 203 corresponds to the first sustaining period $T_{sa}$. The period indicated by 204 corresponds to the off time period $T_e$. The period indicated by 205 corresponds to the second sustaining period $T_{sb}$.

Now, the voltages on the first to x-th column signal lines $S_1$ to $S_x$ during the period 202 will be described in reference to FIG. 3A.

During the period 202, a signal is input to the m-th row scanning line $G_m$ from the scanning line drive circuit 304, whereby the scanning line $G_m$ is selected. Then, the switching transistors 323 of all pixels 301 connected to the scanning line $G_m$ (pixels 301 in the m-th row) are turned on.

In this condition, as shown in FIG. 3AD, analog video signals are input in turn to the first to x-th column pixels 301 located in the m-th row through the signal lines $S_1$ to $S_x$ from the signal line drive circuit 303.

Next, the voltage on the source line $C_m$ in the m-th row during the period 201 will be described in reference to FIG. 3B.

The source line $C_m$ is kept at a constant voltage during the addressing period $T_a$ indicated by 202, the first sustaining period $T_{sa}$ indicated by 203, and the second sustaining period $T_{sb}$ indicated by 205 because the power source 305 supplies a voltage to the source line $C_m$. However, during the off time period $T_e$ indicated by 204, the source line $C_m$ and power source 305 are not connected electrically. Accordingly, the voltage in the source line $C_m$ during the off time period $T_e$ is illustrated with a dotted line.

As described above, a feature of the method of driving a light-emitting device in the embodiment is that the off time period $T_e$ is set for each one frame. During the off time period $T_e$, the switch between the power source 305 and the source lines $C_1$ to $C_y$ connected to the opposite electrodes of the light-emitting elements 326 is turned off. Then, the opposite electrodes of the light-emitting elements 326 become electrically floated and therefore no current is supplied to the light-emitting elements 326.

Further, the off time period $T_{e1}$ may be such that no current can be supplied to the light-emitting elements 326 by making the pixel electrodes of the light-emitting elements 326 and the respective opposite electrodes thereof identical in potential in the condition where the switch located between the source lines $C_1$ to $C_y$ and the power source 305 is maintained on. When there is no difference in potential between both electrodes of the light-emitting element 326, the light-emitting element 326 is supplied with no current and thus the light-emitting element 326 becomes nonluminous.

Incidentally, the illustrations of periods concerning the horizontal retrace line are omitted in FIGS. 3A and 3B.

Setting the off time period $T_e$ in this way can produce a period during which the light-emitting element 326 included in each pixel is nonluminous. As a result, the degradation with age of light-emitting elements 326 can be reduced. In addition, the reliability of light-emitting elements 326 can be increased.

A feature of the method of driving a light-emitting device in the embodiment is that the start timings of the off time period $T_e$ are identical for all the pixels 301.

While one off time period $T_e$ is set for each frame in this embodiment, the invention is not so limited: One off time period $T_e$ may be set every a few frames. Further, a few off time periods $T_e$ may be set for each frame.

While the start timings of the off time period $T_e$ are identical for all the pixels 301 in this embodiment, the invention is not so limited. For example, the start timings of the off time period $T_e$ may vary among the rows. In order to make the start timings different from row to row, however, it is necessary to provide one switch for each of the source lines $C_1$ to $C_y$ between the source line and the power source 305. In this case, the start of the off time period. $T_e$ can be controlled in each row by controlling such switch.

Third Embodiment

In this embodiment, the relation between methods of driving a light-emitting device and a life time of the light-emitting device will be described in reference to FIGS. 5A and 5B.

Figure 5A:
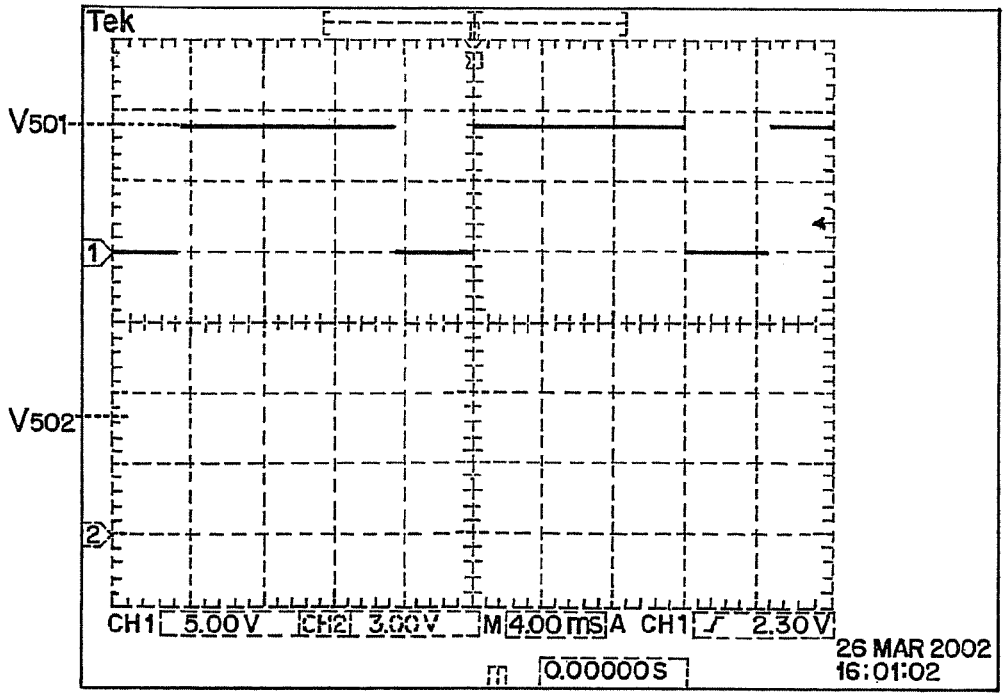
FIGS. 5A and 5B are graphs showing the relation between methods of driving a light-emitting device and the life time of the light-emitting device.

In FIG. 5A, the reference numeral 501 represents waveform of the analog drive voltage with the off time periods; the numeral 502 indicates waveform of the analog drive voltage with no off time periods. Incidentally, being defined voltages $V_{501}$ and $V_{502}$ as voltages during light-emitting time of each driving method, the relation of $V_{501}>V_{502}$ is satisfied.

Figure 5B:
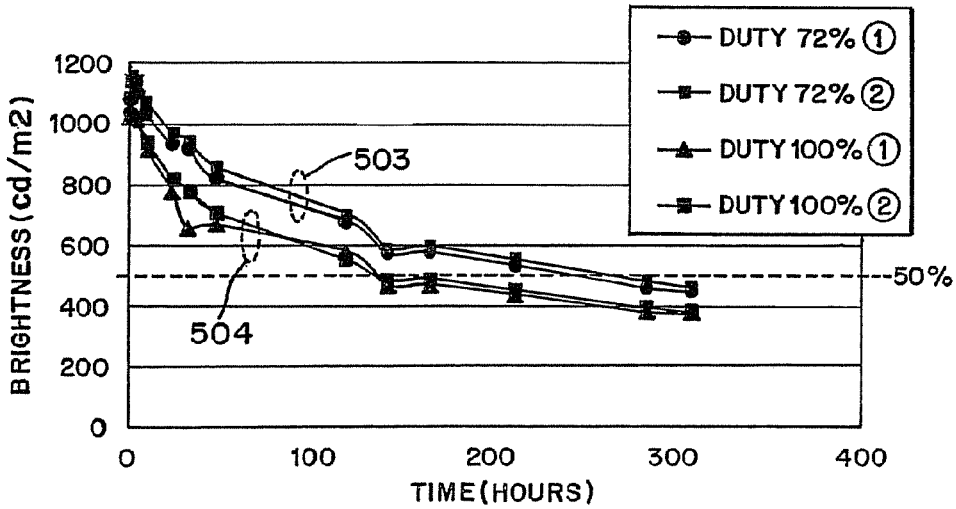

In FIG. 5B, the horizontal axis indicates time and the vertical axis indicates the brightness. In FIG. 5B, the line graphs 503 with circles and squares illustrate the relation between time and the brightness of a light-emitting element driven with the voltage indicated by the numeral 501. In addition, the line graphs with 504 with triangles and squares illustrates the relation between time and the brightness of a light-emitting element driven with the voltage indicated by the numeral 502.

As shown in FIG. 5B, the light-emitting element driven with the voltage indicated by the numeral 501 has a longer life time than the light-emitting element driven with the voltage indicated by the numeral 502. It is understood from this that when comparing the case of having periods during which no voltage is applied to the light-emitting element with the case where a voltage is applied to the light-emitting element all the time, the former can make the life time of a light-emitting element longer. In other words, when comparing the case of having periods during which the light-emitting element is nonluminous with the case where the light-emitting element is luminous all the time, it is understood that the light-emitting element in the former case has a longer life time.

Even though the voltages $V_{501}$ and $V_{502}$ satisfy the relation of $V_{501}>V_{502}$, the light-emitting element driven with the voltage indicated by the numeral 501 has a longer life time. This shows that even when a high voltage is applied to a light-emitting element, the light-emitting element with periods during which a light-emitting element is nonluminous has a longer life time compared to that without such nonluminous periods.

It is clear from the result that a method of driving a light-emitting device according to the invention is very useful, wherein a time during which the pixel is nonluminous (off time period) is set in each frame period. Using a method of driving a light-emitting device according to the invention, it becomes possible to improve the life time of light-emitting elements and reduce the gradation with age of the light-emitting elements. In addition, the reliability of light-emitting elements can be also increased.

Fourth Embodiment

Figure 4D:
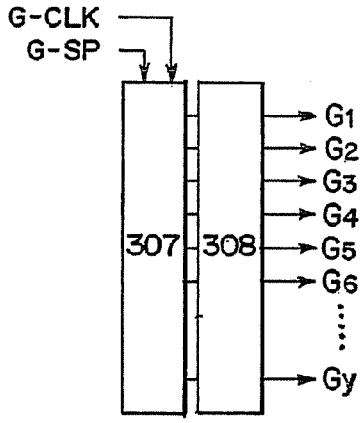

In this embodiment, arrangements of the signal line drive circuit 303 and the scanning line drive circuit 304 and their operations will be described in reference to FIGS. 4C and 4D.

Figure 4C:
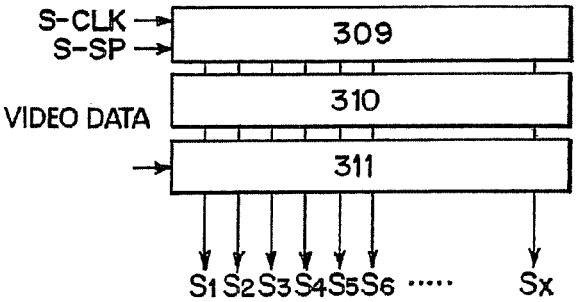

FIG. 4C shows the inner structure of the signal line drive circuit 303. The signal line drive circuit 303 has a shift register 309, a buffer 310, and a sampling circuit 311. The operation of the signal line drive circuit is briefly described below. The shift register 309 sequentially outputs sampling pulses according to clock signals (S-CLK), start pulses (S-SP), and clock inverted signals (S-CLKb). After that, the buffer 310 amplifies the sampling pulses to input to the sampling circuit 311. The sampling circuit 311, into which analog video signals entered, supplies the video signals to the signal lines $S_1$ to $S_x$ according to the timing at which the sampling pulses are input.

FIG. 4C shows the inner structure of the scanning line drive circuit 304. The scanning line drive circuit 304 has a shift register 307 and a buffer 308. The operation of the scanning line drive circuit is briefly described below. The shift register 307 sequentially outputs sampling pulses according to clock signals (G-CLK), start pulses (G-SP), and clock inverted signals (G-CLKb). After that, the sampling pulses are amplified by the buffer 308 to be input to the scanning lines $G_1$ to $G_y$, thereby bringing the scanning lines to selected states in rows. Then, analog video signals are in turn written from the signal line $S_1$ to $S_x$ into the pixels, which are controlled through the selected scanning line $G_n$.

Incidentally, the arrangement such that a level shifter circuit is placed between the shift register 307 and the buffer 308 may be adopted. Voltage amplitudes of the logic circuit section and the buffer section can be changed by placing the level shifter circuit.

Note that it is possible to arbitrarily combine this embodiment with the embodiments 1 and 2.

Fifth Embodiment

Electronic apparatuses applying the driving method of the light emitting device of the present invention include, for example, video cameras, digital cameras, goggle type displays (head mount displays), navigation systems, audio reproducing apparatuses (such as car audio and audio components), notebook personal computers, game machines, mobile information terminals (such as mobile computers, mobile phones, portable game machines, and electronic books), and image reproducing apparatuses provided with a recording medium (specifically, apparatuses for reproducing a recording medium such as a digital versatile disc (DVD), which includes display capable of displaying images). Practical examples thereof are shown in FIGS. 6A-6H.

Figure 6A:
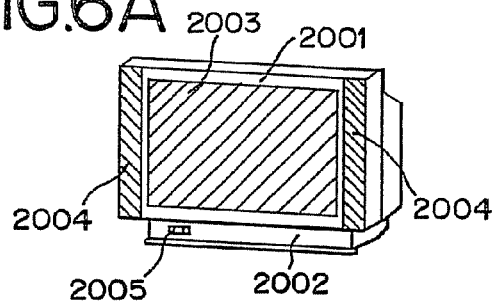
FIGS. 6A-6H are views of electronic devices, to which a method of driving a light-emitting device according to the invention can be applied.

FIG. 6A shows a light emitting device, which contains a casing 2001, a support base 2002, a display portion 2003, a speaker portion 2004, a video input terminal 2005, and the like. The present invention can be applied to the display portion 2003. Further, the light emitting device shown in FIG. 6A is completed with the present invention. Since the light emitting device is of self-light emitting type, it does not need backlight, and therefore a display portion thinner than that of a liquid crystal display can be obtained. Note that light emitting devices include all information display devices, for example, personal computers, television broadcast transmitter-receivers, and advertisement displays.

Figure 6B:
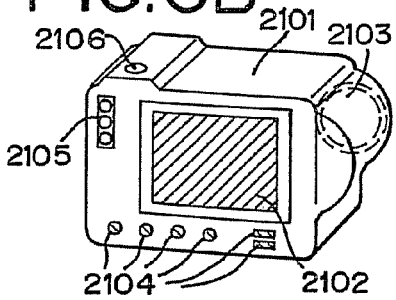

FIG. 6B shows a digital still camera, which contains a main body 2101, a display portion 2102, an image receiving portion 2103, operation keys 2104, an external connection port 2105, a shutter 2106, and the like. The present invention can be applied to the display portion 2102. Further, the digital still camera shown in FIG. 6B is completed with the present invention.

Figure 6C:
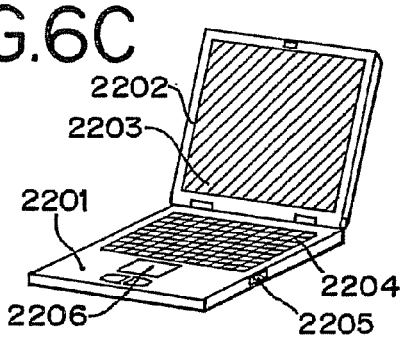

FIG. 6C shows a notebook personal computer, which contains a main body 2201, a casing 2202, a display portion 2203, a keyboard 2204, external connection ports 2205, a pointing mouse 2206, and the like. The present invention can be applied to the display portion 2203. Further, the notebook personal computer shown in FIG. 6C is completed with the present invention.

Figure 6D:
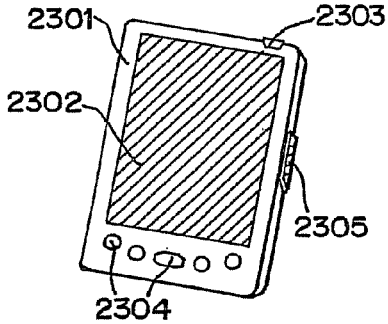

FIG. 6D shows a mobile computer, which contains a main body 2301, a display portion 2302, a switch 2303, operation keys 2304, an infrared port 2305, and the like. The present invention can be applied to the display portion 2303. Further, the mobile computer shown in FIG. 6D is completed with the present invention.

Figure 6E:
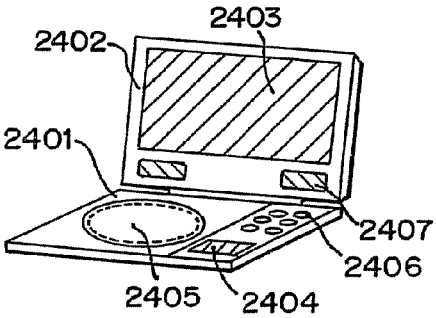

FIG. 6E shows a portable image reproducing device provided with a recording medium (specifically, a DVD reproducing device), which contains a main body 2401, a casing 2402, a display portion A 2403, a display portion B 2404, a recording medium (such as a DVD) read-in portion 2405, operation keys 2406, a speaker portion 2407, and the like. The display portion A 2403 mainly displays image information, and the display portion B 2404 mainly displays character information. The present invention can be used in the display portion A 2403 and in the display portion B 2404. Note that family game machines and the like are included in the image reproducing devices provided with a recording medium. Further, the DVD reproducing device shown in FIG. 6E is completed with the present invention.

Figure 6F:
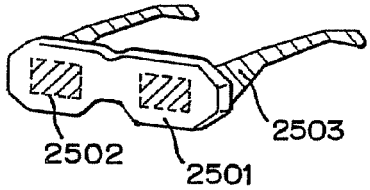

FIG. 6F shows a goggle type display (head mounted display), which contains a main body 2501, a display portion 2502, an arm portion 2503, and the like. The present invention can be used in the display portion 2502. The goggle type display shown in FIG. 6F is completed with the present invention.

Figure 6G:
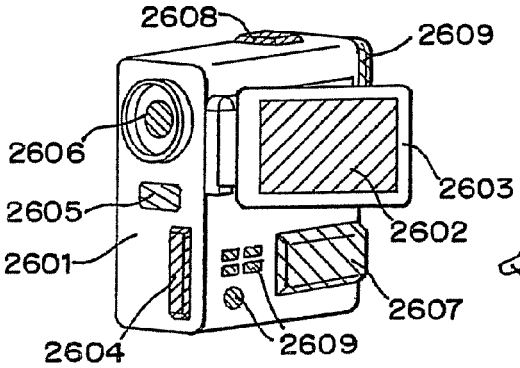

FIG. 6G shows a video camera, which contains a main body 2601, a display portion 2602, a casing 2603, external connection ports 2604, a remote control reception portion 2605, an image receiving portion 2606, a battery 2607, an audio input portion 2608, operation keys 2609, an eyepiece portion 2610, and the like. The present invention can be used in the display portion 2602. The video camera shown in FIG. 6G is completed with the present invention.

Figure 6H:
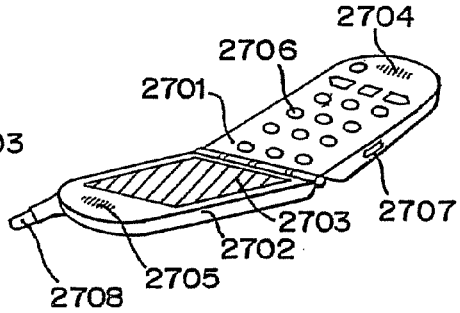
Figure 7:
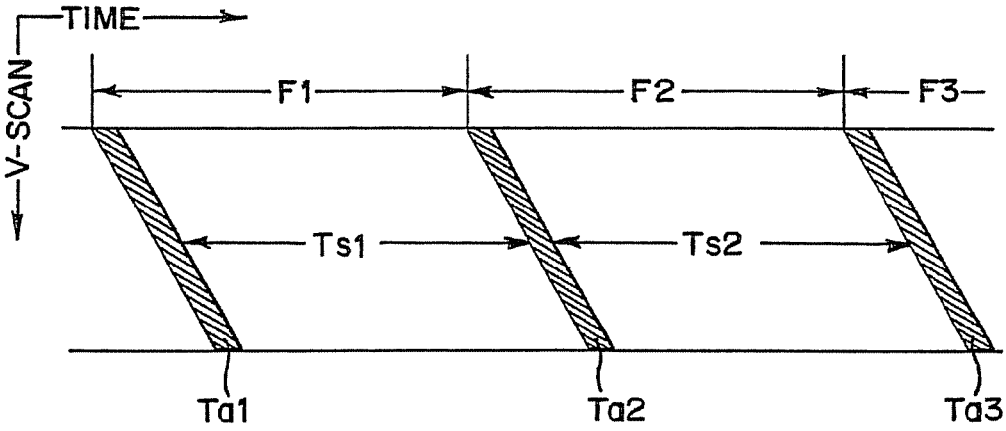
FIG. 7 PRIOR ART
FIG. 7 is an illustration used for the explanation of a method of driving a light-emitting device.

Here, FIG. 6H shows a mobile telephone, which contains a main body 2701, a casing 2702, a display portion 2703, an audio input portion 2704, an audio output portion 2705, operation keys 2706, external connection ports 2707, an antenna 2708, and the like. The present invention can be used in the display portion 2703. Note that, by displaying white characters on a black background, the display portion 2703 can suppress consumption of currents of the mobile telephone. Further, the mobile telephone shown in FIG. 6H is completed with the present invention.

When the emission brightness of light emitting materials becomes brighter in the future, the light emitting device will be able to be applied to a front or rear type projector by expanding and projecting light containing image information having been output lenses or the like.

Cases that the above-described electronic apparatuses display information distributed via electronic communication lines such as the Internet and CATVs (cable TVs), are increasing. Particularly increased are cases where moving picture information is displayed. Since the response speed of the light emitting material is very high, the light emitting device is preferably used for moving picture display.

Since the light emitting device consumes power in light emitting portions, information is desirably displayed so that the light emitting portions are reduced as much as possible. Thus, in the case where the light emitting device is used for a display portion of a mobile information terminal, particularly, a mobile telephone, an audio playback device, or the like, which mainly displays character information, it is preferable that the character information be formed in the light emitting portions with the non-light emitting portions being used as the background.

As described above, the application range of the present invention is so wide that the invention can be used for electronic apparatuses in all of the fields. The electronic apparatuses according to this embodiment may use the light emitting device with the structure according to any one of the first embodiment to fourth embodiment.

A feature of a method of driving a light-emitting device according to the present invention is that two addressing periods, the first and the second addressing periods $T_a$ and $T_b$, are set generally in one frame. During the first addressing period $T_a$, analog video signals are written into the pixels; during the second addressing period $T_b$, signals to turn off the driving transistors of the pixels are written into the pixels. Further, as soon as the second addressing period $T_b$ expires, the off time period $T_e$ during which the pixel 301 is nonluminous starts. A feature of the method of driving a light-emitting device in the embodiment of the invention is also that the off time period $T_e$ is set in one frame in this way. Setting the off time period $T_e$ can produce a period during which the light-emitting element of each pixel is nonluminous. As a result, the degradation with age of light-emitting elements can be reduced. In addition, the reliability of light-emitting elements can be increased.

According to the invention, wherein non-display periods can be set by signal inputs, it is not necessary to arrange a circuit specifically designed to set the non-display periods. If such special-purpose circuit is arranged, it is required to integrate the circuit with the pixel portion or to place the circuit as an IC or the like outside the pixel portion. However, the invention needs neither of these ways. According to the arrangement, low-profile and lightweight devices can be provided. Therefore, the invention is specifically useful for handheld terminals, whose development has been proceeding actively in recent years.

A feature of the method of driving a light-emitting device according to the invention is that the light-emitting elements are prevented from being supplied with current by making the opposite electrodes of the light-emitting elements electrically floated during the off time period $T_e$. A feature of the method of driving a light-emitting device according to the invention is also that the light-emitting elements are prevented from being supplied with current by making the pixel electrode of each of the light-emitting elements and the opposite electrode thereof identical in potential. When doing so, periods during which the light-emitting element of each pixel is nonluminous can be set. As a result, the degradation with age of the light-emitting elements can be reduced. In addition, the reliability of light-emitting elements can be increased.

According to the invention, wherein the point sequential scanning is performed, the drive circuit on the side of the source is less loaded compared to the case of performing the line sequential scanning. This is because a holding circuit for holding signals for a time needs to be placed in the case of performing the line sequential scanning, whereas it is not required to place such holding circuit in the case of performing the point sequential scanning. Therefore, according to the invention, wherein the point sequential scanning is performed, an area occupied by the drive circuit on the side of the source can be decreased in the case where the pixel portion and drive circuit are integrally formed on a substrate. In addition, according to the invention, the number of elements on the substrate can be reduced, so that the production yield and reliability thereof can be increased.

The invention claimed is:

1. A method of driving a light-emitting device comprising a pixel comprising a first transistor, a second transistor and a light-emitting element, the method comprising steps of:

inputting an analog video signal to a gate of the second transistor through the first transistor to supply the light-emitting element and the second transistor with a current in accordance with the analog video signal in a first period, and inputting a signal to the pixel to make the light-emitting element nonluminous in a second period, wherein one frame period comprises the first period and the second period.

2. The method of driving a light-emitting device according to claim 1, wherein each of the first transistor and the second transistor is a thin film transistor.

3. The method of driving a light-emitting device according to claim 1, wherein a gate of the first transistor is electrically connected to a scanning line, wherein one of a source and a drain of the first transistor is electrically connected to a source line, wherein the other of the source and the drain of the first transistor is electrically connected to the gate of the second transistor, wherein one of a source and a drain of the second transistor is electrically connected to a first source line, wherein the other of the source and the drain of the second transistor is electrically connected to a first electrode of the light-emitting element, and wherein a second electrode of the light-emitting element is electrically connected to a second source line.

4. The method of driving a light-emitting device according to claim 1, wherein the pixel comprises a capacitor.

5. The method of driving a light-emitting device according to claim 1, wherein the pixel comprises a capacitor, wherein a first electrode of the capacitor is electrically connected to the gate of the second transistor, and wherein a second electrode of the capacitor is electrically connected to the one of a source and a drain of the second transistor.

6. The method of driving a light-emitting device according to claim 1, wherein the light-emitting element is an organic light emitting diode.

7. A electronic equipment using the method of driving a light-emitting device according to claim 1.

8. The method of driving a light-emitting device according to claim 1, wherein the light-emitting device further comprises a signal line drive circuit comprising a sampling circuit, and wherein the sampling circuit samples a video data and supplies the analog video signal to the gate of the second transistor through the first transistor.

9. The method of driving a light-emitting device according to claim 1, wherein the light-emitting device further comprises a signal line drive circuit comprising a shift register and a sampling circuit, wherein the shift register supplies a sampling pulse to the sampling circuit, and wherein the sampling circuit samples a video data and supplies the analog video signal to the gate of the second transistor through the first transistor in accordance with the sampling pulse.

10. A method of driving a light-emitting device comprising a pixel comprising a first transistor, a second transistor and a light-emitting element, the method comprising steps of:

making the light-emitting element luminous by inputting an analog video signal to a gate of the second transistor through the first transistor to supply the light-emitting element and the second transistor with a current in accordance with the analog video signal in a first period; and making the light-emitting element nonluminous in a second period, wherein one frame period comprises the first period and the second period.

11. The method of driving a light-emitting device according to claim 10, wherein each of the first transistor and the second transistor is a thin film transistor.

12. The method of driving a light-emitting device according to claim 10, wherein a gate of the first transistor is electrically connected to a scanning line, wherein one of a source and a drain of the first transistor is electrically connected to a source line, wherein the other of the source and the drain of the first transistor is electrically connected to the gate of the second transistor, wherein one of a source and a drain of the second transistor is electrically connected to a first source line, wherein the other of the source and the drain of the second transistor is electrically connected to a first electrode of the light-emitting element, and wherein a second electrode of the light-emitting element is electrically connected to a second source line.

13. The method of driving a light-emitting device according to claim 10, wherein the pixel comprises a capacitor.

14. The method of driving a light-emitting device according to claim 10, wherein the pixel comprises a capacitor, wherein a first electrode of the capacitor is electrically connected to the gate of the second transistor, and wherein a second electrode of the capacitor is electrically connected to the one of a source and a drain of the second transistor.

15. The method of driving a light-emitting device according to claim 10, wherein the light-emitting element is an organic light emitting diode.

16. A electronic equipment using the method of driving a light-emitting device according to claim 10.

17. The method of driving a light-emitting device according to claim 10, wherein the light-emitting device further comprises a signal line drive circuit comprising a sampling circuit, and wherein the sampling circuit samples a video data and supplies the analog video signal to the gate of the second transistor through the first transistor.

18. The method of driving a light-emitting device according to claim 10, wherein the light-emitting device further comprises a signal line drive circuit comprising a shift register and a sampling circuit, wherein the shift register supplies a sampling pulse to the sampling circuit, and wherein the sampling circuit samples a video data and supplies the analog video signal to the gate of the second transistor through the first transistor in accordance with the sampling pulse.

* * * * *

UNITED STATES PATENT AND TRADEMARK OFFICE

CERTIFICATE OF CORRECTION

PATENT NO. : 8,593,381 B2
APPLICATION NO. : 13/609712
DATED : November 26, 2013
INVENTOR(S) : Mitsuaki Osame et al.

It is certified that error appears in the above-identified patent and that said Letters Patent is hereby corrected as shown below:

In the Specification:

Column 4, line 61; Change "line a" to --line Gj, a--.

Column 4, line 62; Change "line $S_1$," to --line Si,--.

Column 5, line 55; Change "$T_s$ the" to --Ts, the--.

Column 6, line 25; Change "$T_{s1}$" to --$T_{a1}$--.

Signed and Sealed this
Fifteenth Day of April, 2014

Michelle K. Lee

Michelle K. Lee
*Deputy Director of the United States Patent and Trademark Office*